US005174712A

United States Patent [19]

Focke et al.

[11] Patent Number: 5,174,712

[45] Date of Patent: Dec. 29, 1992

[54] APPARATUS FOR HOLDING STATIONARY A STACK OF ARTICLES WHILE LIFTING A SHEET BY SUCTION FROM THE TOP OF THE STACK

[75] Inventors: Heinz Focke, Verden; Kurt Liedtke, deceased, late of Verden, both of Fed. Rep. of Germany, by Ruth Liedtke, heir

[73] Assignee: Focke & Co., (GmbH & Co.), Verden, Fed. Rep. of Germany

[21] Appl. No.: 635,095

[22] Filed: Dec. 28, 1990

[30] Foreign Application Priority Data

Jan. 16, 1990 [DE] Fed. Rep. of Germany ..... 4001053

[51] Int. Cl.[5] ..... B65G 59/04; B65H 3/08; B65H 3/30

[52] U.S. Cl. ..... 414/796.5; 294/64.1; 414/796.2; 414/929

[58] Field of Search ..... 414/797, 795.7, 795.9, 414/796.9, 796.5, 796.2, 929, 907; 271/10, 11, 19, 20, 18.3, 106, 19, 24; 294/64.1

[56] References Cited

U.S. PATENT DOCUMENTS

| | | | |
|---|---|---|---|
| 4,256,428 | 3/1981 | Kitayama et al. | 414/797 |
| 4,383,795 | 5/1983 | Wakamatsu et al. | 414/796.9 X |
| 4,516,762 | 5/1985 | Moltraiso et al. | 414/797 X |
| 4,625,953 | 12/1986 | Hamatani . | |
| 4,671,723 | 6/1987 | Feldkamper | 414/796.5 X |
| 4,911,608 | 3/1990 | Krappitz et al. | 414/929 X |
| 4,988,264 | 1/1991 | Winski | 414/796.2 X |
| 4,993,915 | 2/1991 | Berger et al. | 414/929 X |
| 5,040,942 | 8/1991 | Brinker et al. | 414/907 X |
| 5,048,811 | 9/1991 | Hochbein | 294/64.1 X |

FOREIGN PATENT DOCUMENTS

| | | | |
|---|---|---|---|
| 80798 | 6/1983 | European Pat. Off. . | |
| 1122893 | 10/1962 | Fed. Rep. of Germany | 414/797 |
| 1212113 | 3/1966 | Fed. Rep. of Germany . | |
| 1995989 | 7/1968 | Fed. Rep. of Germany . | |
| 2222678 | 4/1973 | Fed. Rep. of Germany . | |
| 2256793 | 2/1974 | Fed. Rep. of Germany . | |
| 2835385 | 5/1979 | Fed. Rep. of Germany . | |
| 3613462 | 10/1987 | Fed. Rep. of Germany | 414/797 |
| 3637567 | 5/1988 | Fed. Rep. of Germany | 414/797 |
| 209734 | 9/1986 | Japan | 414/797 |
| 277530 | 12/1986 | Japan | 414/796.9 |
| 1258688 | 9/1986 | U.S.S.R. | 414/797 |
| 966957 | 8/1964 | United Kingdom . | |

*Primary Examiner*—David A. Bucci
*Attorney, Agent, or Firm*—Sughrue, Mion, Zinn, Macpeak & Seas

[57] ABSTRACT

On pallets loaded with several layers (tiers 11), relatively thin intermediate layers 13 made of cardboard or the like are usually located between the tiers 11. These intermediate layers have to be removed after a tier 11 has been unloaded. For this purpose, a suction lifter 16 with a suction plate 17 is provided, which lifts and discharges the free intermediate layer by means of a vacuum. To avoid undesirable relative displacements of the stacked articles (blank stacks 12), the suction lifter 16 is provided with holding-down devices 22. These devices 22 pass through openings 23 in the intermediate layer 13 and come to abut the blank stacks 12, such that the latter are fixed in place when the intermediate layer 13 is lifted. Profile members 31 are arranged on the suction lifter 16 for further securing the articles (blank stacks 12). These members 31 enter cavities 32 formed between adjacent articles (blank stacks 12) in a form-fitting positive manner.

14 Claims, 6 Drawing Sheets

APPARATUS FOR HOLDING STATIONARY A STACK OF ARTICLES WHILE LIFTING A SHEET BY SUCTION FROM THE TOP OF THE STACK

BACKGROUND OF THE INVENTION

The invention relates to an apparatus for lifting planiform articles, especially sheet-like (intermediate) layers, off an underlayer, for instance off (blank) stacks of a pallet or the like, by means of a suction lifter which can be placed on the top side of the (intermediate) layer with suction bores.

Articles are often stacked on pallets in tiers, with a thin sheet-like intermediate layer being arranged between the individual tiers. This intermediate layer or separator may be made of cardboard, in particular corrugated cardboard, or sometimes of a synthetic material.

The tiers may consist of individual articles arranged side-by-side in each tier, or of (small) stacks of sheet-like articles. An important example is the arrangement of pre-fabricated blanks of thin cardboard for producing packs, especially hinge lid (cigarette) packs. The specially designed blanks are assembled in stacks of, for instance, one thousand blanks and are placed on a pallet side-by-side as a tier for transport and storage. The above-mentioned intermediate cardboard layers are located between the tiers of a group of tiers stacked above one another.

Usually, automatic depalletizers are used for unloading the pallets on site. These may be constructed in different ways. In any case, there still remains the problem of removing the intermediate layers after unloading a tier.

Heretofore, the intermediate layers have been lifted off the tiers of the pallets mainly by hand. There are, however, automatic depalletizers known in the packaging industry which are equipped with a suction lifter for engaging the top side of stacked articles.

The (manual or mechanical) removal of the intermediate layers involves the risk of the articles of the tiers being displaced relative to one another. This is particularly the case when the tiers are formed of blank stacks, since the latter have a low dead weight and can be easily shifted relative to one another. There is also the risk of the upper blanks of the blank stacks being lifted off together with the intermediate layer.

SUMMARY OF THE INVENTION

To solve this problem, the invention has as an object to further mechanize and simplify the unloading of pallets or the like, and in particular to secure the articles of the tiers against being displaced when an intermediate layer is lifted.

To attain this object, the apparatus of the invention is characterized in that the suction lifter (suction plate) has supporting means (holding-down devices) which, when the suction lifter contacts the intermediate layer, pass through openings in the intermediate layer and bear against the articles (blank stacks) located thereunder while the intermediate layer is lifted off.

Thus, the articles of the tier, in particular a plurality of side-by-side blank stacks, are mechanically secured against displacement during the first stage of lifting off an intermediate layer. For this purpose, holding-down devices are provided which bear against the articles or blank stacks with a certain pressure and therewith fix the latter in position, while at the same time the intermediate layer is lifted off the tier by means of an upward movement of the suction lifter.

According to the invention, the intermediate layer is designed with openings which allow the holding-down devices to pass through until they directly abut the articles (blank stacks).

The suction lifter can be designed such that the number of holding-down devices provided on the bottom side thereof corresponds to the number of articles. Alternatively, the holding-down devices may also be designed, dimensioned and arranged such, that, when the suction lifter is in lowered position, each holding-down device engages a plurality of articles or blank stacks at the top side and thus fixes these articles in place by a transmission of pressure. Such holding-down devices may particularly comprise circular stamp plates arranged on pressure rods which take effect at those points where the corners of several blank stacks, for instance of four adjacent blank stacks, meet.

The holding-down devices are movably mounted on the suction lifters, specifically in an up-and-down movable manner. Furthermore, the holding-down devices are spring-loaded in the direction of the extended position. This ensures that the holding-down devices remain in the holding position in which they abut the articles during the first stage of the upward movement of the suction lifter, in which the latter already lifts up the intermediate layer. As the lifting movement of the suction lifter continues, the extended holding-down devices are lifted as well.

The invention is further concerned with securing the articles of a tier in transverse direction. This particularly applies to said blank stacks for hinge lid (cigarette) packs. These blanks have a characteristic special geometric shape, so that cavities of a specific shape, namely angular or V-shaped cavities, are formed between adjacent blank stacks. Guiding or supporting means of the suction lifter enter these cavities in order to secure the exact stack formation of the blank stacks. These means are elongate profile members whose cross-section is adapted to the cross-section of the cavities.

According to the invention, the profile members are arranged on the bottom side of the holding-down devices and are therefore inserted into the cavities between the intermediate layers when the suction lifter is lowered down. The dimensions of the profile members are such that in lowered position of the suction lifter, the profile members extend across the full height of a blank stack or enter with one end the opening of an intermediate layer located thereunder. The blank stacks are thus aligned or supported across their complete height.

Further features of the invention relate to the construction of the suction lifter and to a complete apparatus for automatically lifting and depositing the intermediate layers.

An exemplary embodiment will be described in the following in more detail with reference to the drawings, in which:

DESCRIPTION OF A PREFERRED EMBODIMENT

Figure 2:
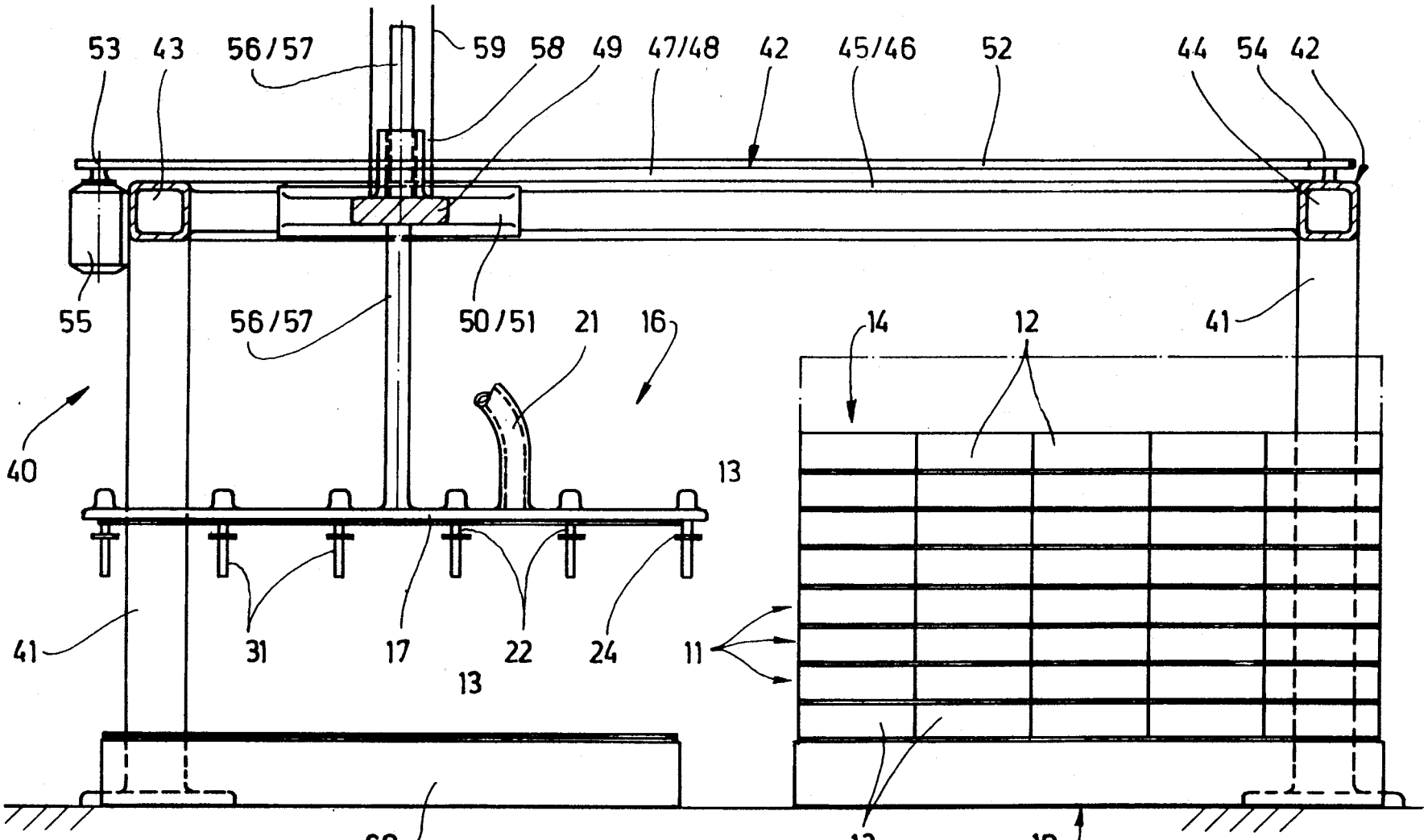
FIG. 2 is a schematic side view of part of an apparatus for unloading pallets.

The embodiment shown in the drawings relates to the unloading of pallets 10. On these pallets 10, layers of articles, namely tiers 11 are arranged (FIG. 2). In the present embodiment, each tier 11 consists of a plurality of blank stacks 12 having the same size and shape. These blank stacks 12 are arranged side-by-side and aligned in longitudinal and transverse rows. Between the tiers 11 lying above one another there are located intermediate layers or separators 13 which may for example be made of (corrugated) cardboard.

Figure 3:
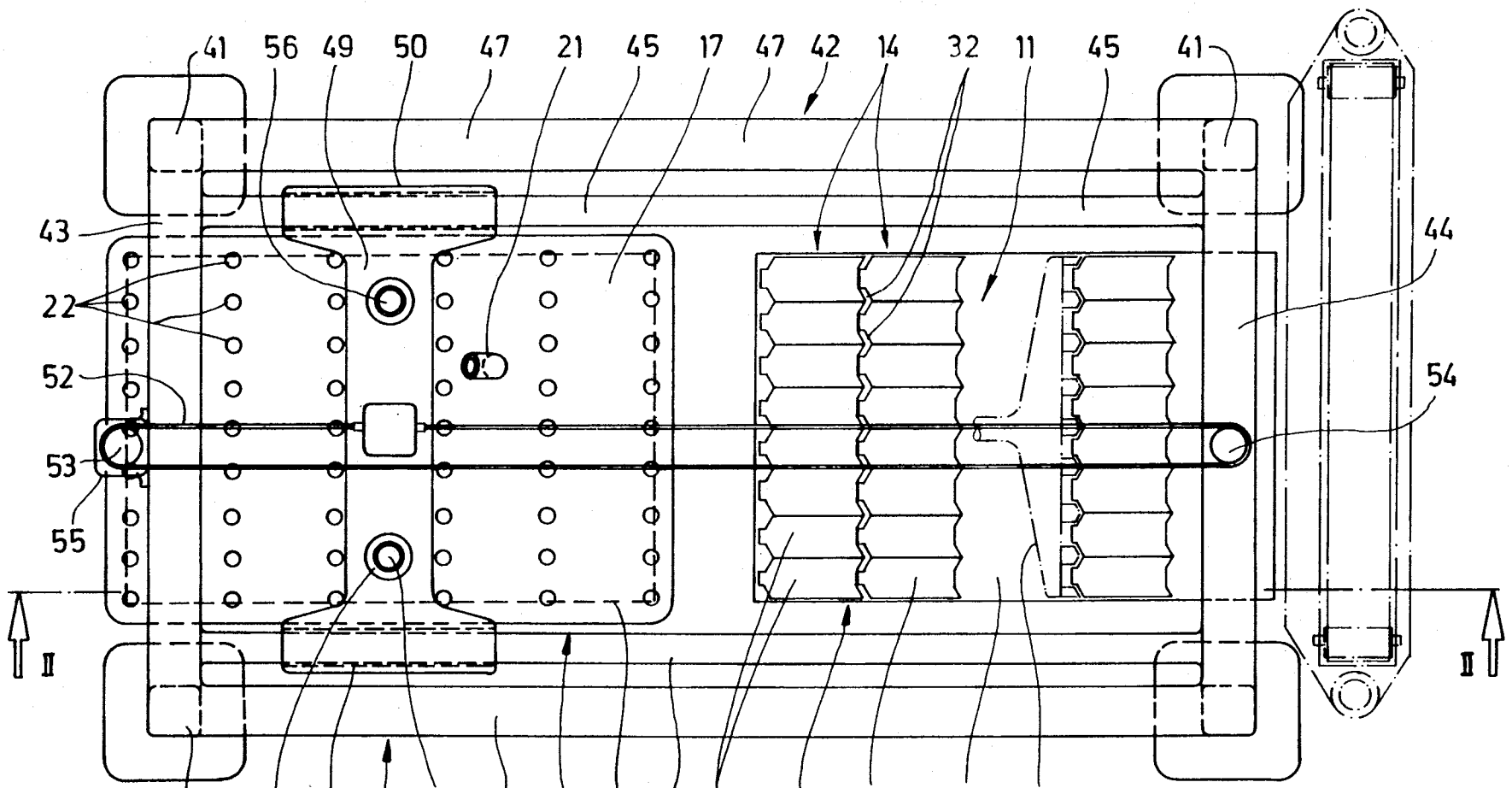
FIG. 3 is a plan view of the representation of FIG. 2.

The pallets 10 are unloaded by successively removing the tiers 11. In the present embodiment, transverse rows 14 of blank stacks 12 are pushed off as a unit from the intermediate layer 13 lying underneath. The transverse row 14 is completely engaged by a pusher 15 (FIG. 3).

After a tier 11 is removed, the intermediate layer 13 has to be taken away, so that the tier 11 located thereunder can also be removed.

A suction lifter 16 (FIGS. 2–6) serves for automatically taking off the intermediate layers 13. This suction lifter 16 consists of a suction plate 17, the size of which is approximately equal to that of the pallet or an intermediate layer 13. The suction plate 17 is lowered onto an intermediate layer 13 for lifting the same. The intermediate layer 13 is fixed to the bottom side of the suction plate 17 by suction bores 18 in the suction plate 17 and can be transported away with said plate. The suction plate 17 is designed as a hollow body having a continuous vacuum chamber 19. The suction bores 18 are formed in a bottom plate wall 20 and are distributed in a way sufficient to hold the full surface of the intermediate layer 13. The suction plate 17, or rather the vacuum chamber 19 is connected to a vacuum source (not shown) via a suction line 21.

The blank stacks 12 must not be displaced when an intermediate layer 13 resting thereon is lifted off the tier 11. For this reason, the blank stacks 12 underneath the intermediate layer 13 which is to be lifted are temporarily fixed in position during the lifting process.

For this purpose, supporting means or holding-down devices 22 are arranged on the suction plate 17. These devices 22 are lowered with the suction plate 17 onto the intermediate layer 13. The intermediate layer 13 is provided with openings or apertures 23 in the region of the holding-down devices 22. These openings 23 are arranged and dimensioned such that the holding-down devices 22 can freely pass through the openings 23 and come to abut the top side of the blank stacks 12.

The holding-down devices 22 are designed as pressure stamps having a circular stamp plate 24 in the present embodiment. This stamp plate 24 passes through the opening 23 and comes to abut the top side of the blank stack 12. The stamp plate 24 is arranged on a pressure rod 25 which is movably mounted in an up-and-down movable manner in the suction plate 17. For this purpose, the suction plate 17 is provided with a plurality of rod housings 26 which are inserted into the suction plate 17 like cylinders. The pressure rod 25 is movably mounted within the rod housing 26 and secured at the free end of the pressure rod 25 against sliding out by means of a collar 27. Furthermore, the pressure rod 25 is guided in a passage 28 of the plate wall 20.

The holding-down devices 28 are constantly or at least during the lowering of the suction plate 17 onto the intermediate layer 13 loaded in the direction of the extended position (FIG. 2, FIG. 4), specifically by means of a pressure spring 29 which is mounted within the rod housing 26 and bears against the free end of the pressure rod 25 (against the collar 27).

In order to pick up an intermediate layer 13, the suction lifter 16 with the suction plate 17 is lowered onto the intermediate layer 13 with the holding-down devices 22 being in extended position, specifically until the plate wall 20 abuts the intermediate layer 13. During the final stage of the lowering movement, the pressure rods 25 are moved into the rod housing 26, thus compressing the pressure spring 29 until the stamp plate 24 abuts the bottom side of the plate wall 20. In this position (FIG. 5), the stamp plate 24 is located within the significantly larger opening 23. In this case, the thickness of the stamp plate 24 corresponds to that of the intermediate layer 13. The stamp plate 24 of the holding-down device 22 rests on the blank stack 12 under the load of the pressure spring 29. The blank stacks are thus pushed down and fixed in place.

Via the suction line, the vacuum source generates a vacuum in the region of the suction bores 18. The intermediate layer 13 is fixed to the suction plate 17 and lifted therewith.

During a first stage of the lifting movement, the holding-down devices 22 extending through the opening 23 remain in abutment with the blank stacks 12 and fix these in place. In the course of this first lifting stage, the pressure rods 25 continue to move out of the rod housing 26 until the collar 27 abuts the rod housing 26 in the region of the passage 28. As the lifting movement continues, the holding-down devices 22 are now lifted off as well. They have now accomplished their task, as the intermediate layer 13 is lifted off the blank stacks 12 lying underneath.

The holding-down devices 22 may be arranged such that each blank stack 12 of the tier 11 is associated with a separate holding-down device. In the present embodiment, with the blank stacks 12 being arranged in longitudinal rows and transverse rows 14, each holding-down device 22 is arranged such that it contacts four blank stacks 12, namely in a region where the corners of four blank stacks meet. As a result, each blank stack 12 is held on all four corners by a holding-down device 22. The openings 23 are arranged in the intermediate layer 13 accordingly.

Figure 7:
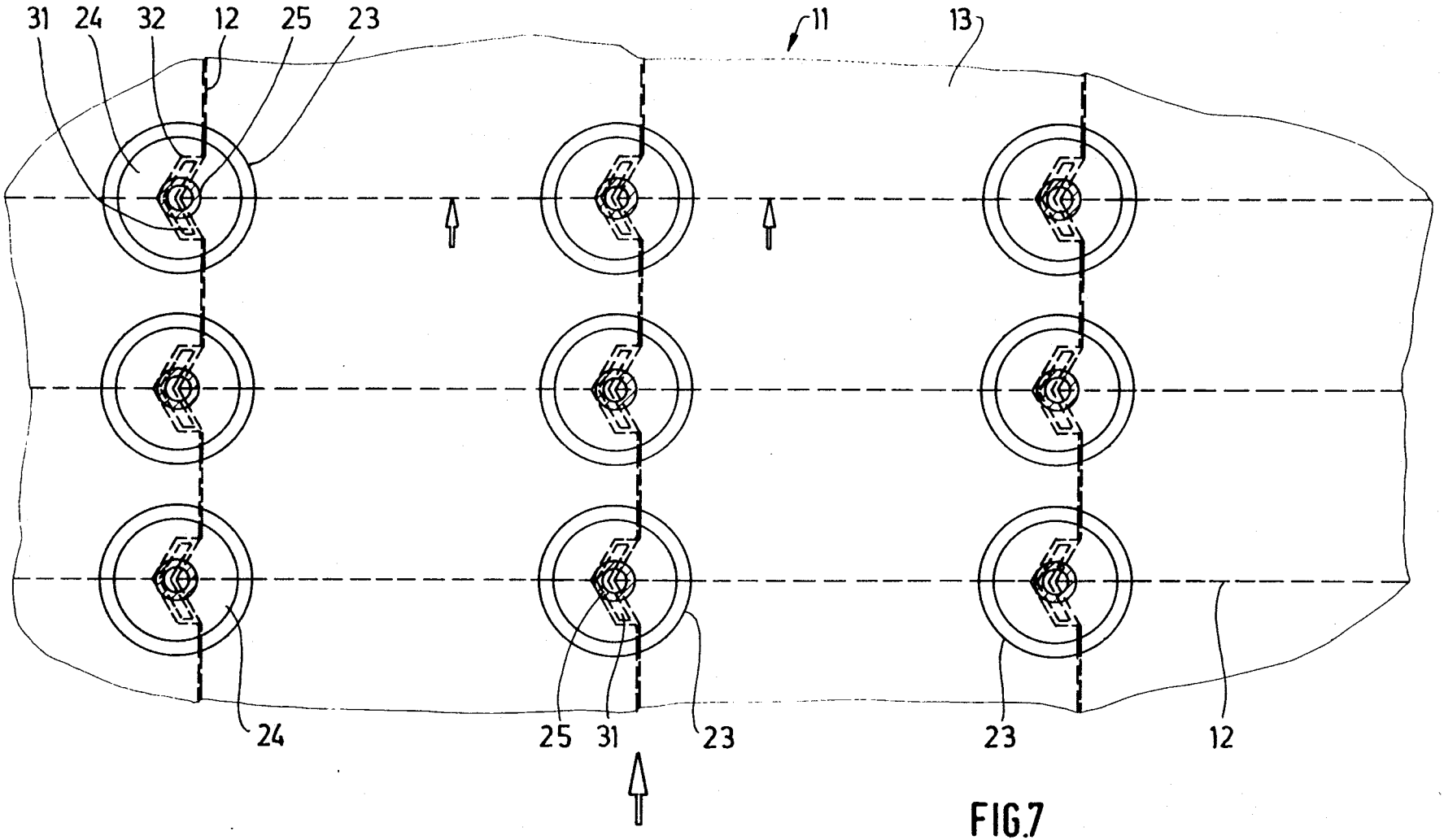
FIG. 7 is a horizontal section or top plan view in the plane VII—VII of FIG. 4.

As a further measure for securing the exact relative position of the blank stacks 12 and the blanks 30 thereof within the blank stack 12, the invention provides guiding means on the suction lifter 16, namely upright profile members 31 with an angular or V-shaped cross-section (FIG. 7). In the present embodiment, such a profile member 31 is arranged on the bottom side of each holding-down device 22.

The profile members 31 enter the cavities 32 (FIGS. 3 and 7) formed between adjacent blank stacks 12 in a form-fitting positive manner. The cavities 32 also have a V-shaped cross-section, so that the profile members 31 positively enter these cavities 32, thus stabilizing the exact alignment of the blank stacks 12.

Figure 1:
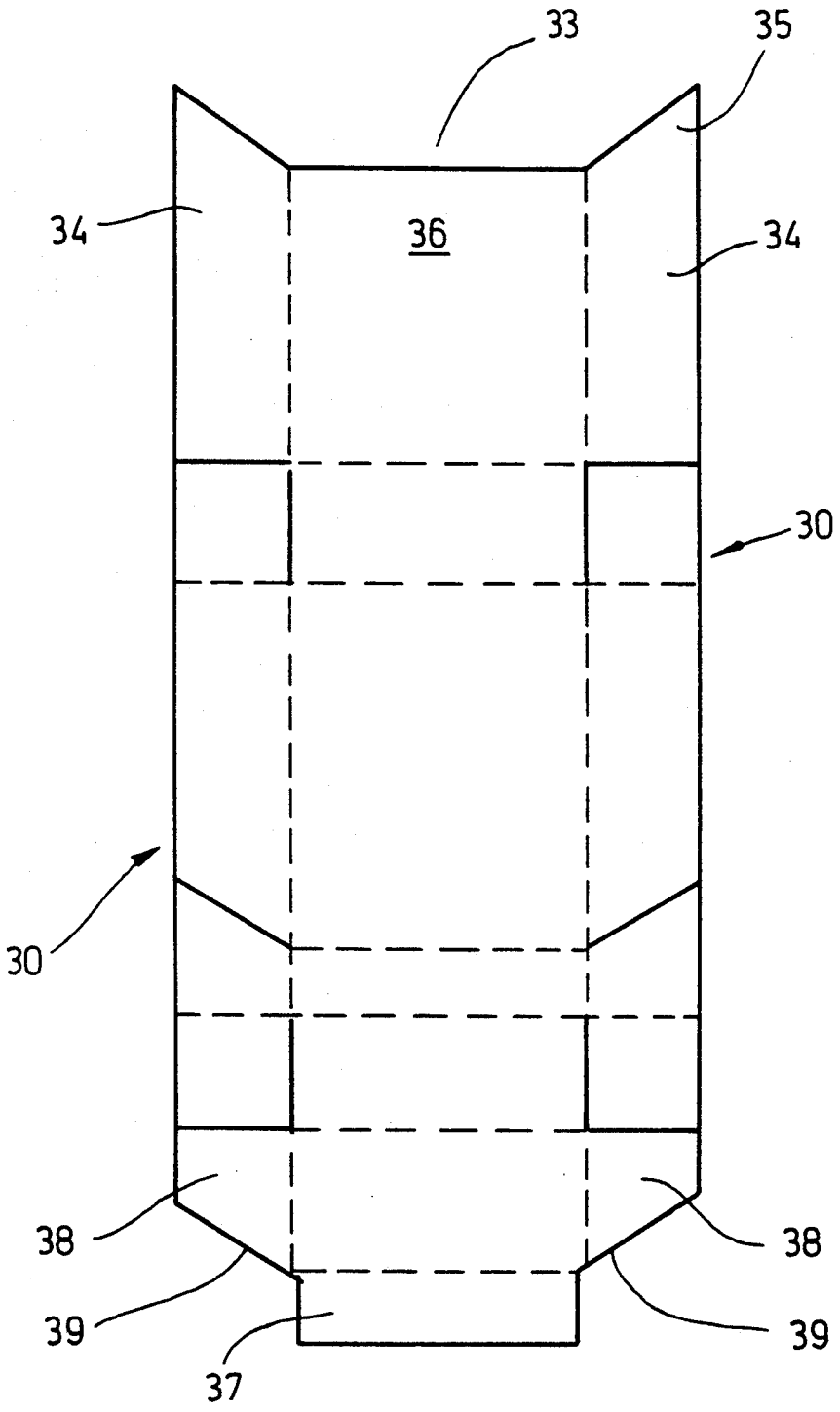
FIG. 1 shows a spread-out blank for a hinge lid pack.

In the present case, the specific shape of the cavities 32 is determined by the shape of the blanks 30 (FIG. 1) which form the blank stacks 12. These blanks 30 are blanks for hinge lid packs for accommodating cigarettes. A trapezoidal recess 33 on one end of the blank 30 is typical for the form of these type of blanks. The recess 33 is formed by triangular end portions of side tabs 34, i.e. triangular gussets 35, projecting from a front wall 36 of the pack to be formed from the blank 30.

On the opposite end of the blank 30, there are portions for forming a lid, namely a projecting inner lid tab 37 which has a significantly smaller width than the rest of the blank. Furthermore, in this region there are located trapezoidal lid side tabs 38 with inclined shoulders 39.

If such blanks 30 are expediently arranged in blank stacks 12, the inner lid tabs 37 of one blank stack 12 enter the recesses 33 of an adjacent blank stack. The shoulders 39 are then located adjacent to inclined edges of the triangular gussets 35. Herewith, an inclined partial cavity is formed which together with a partial cavity of two adjacent blank stacks 12 forms the (complete) cavity having a V-shaped cross-section.

Figure 4:
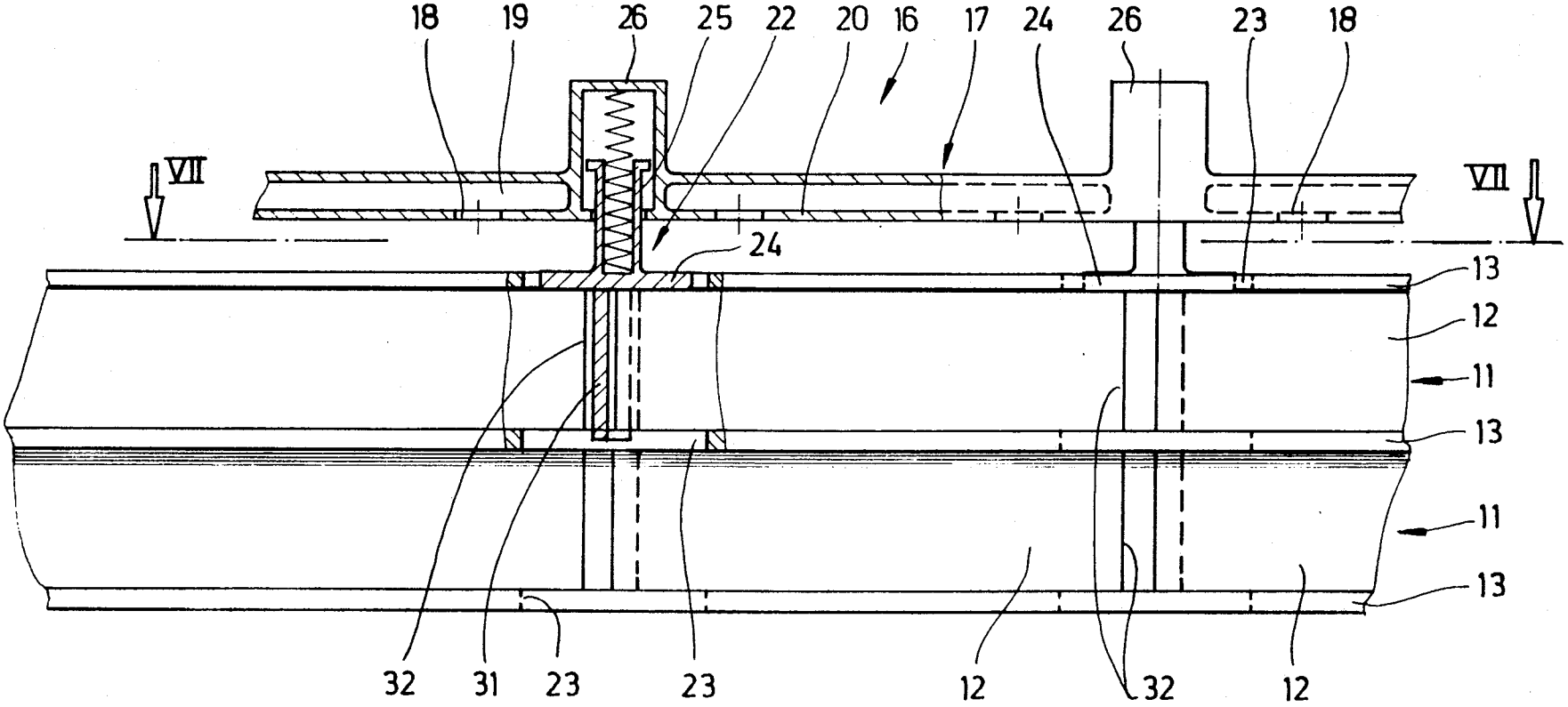
FIG. 4 is a side view or vertical section of a detail of a suction lifter with tiers of a pallet.
Figure 5:
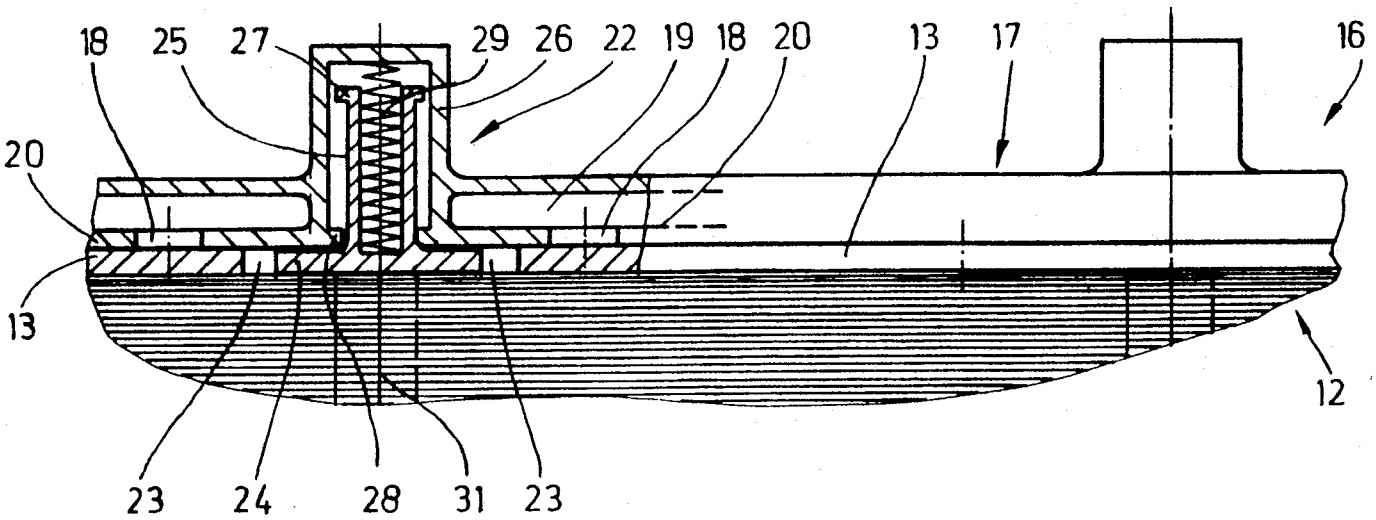
FIG. 5 is a section of the suction lifter as shown in FIG. 4, on an enlarged scale and at a different stage of movement.
Figure 6:
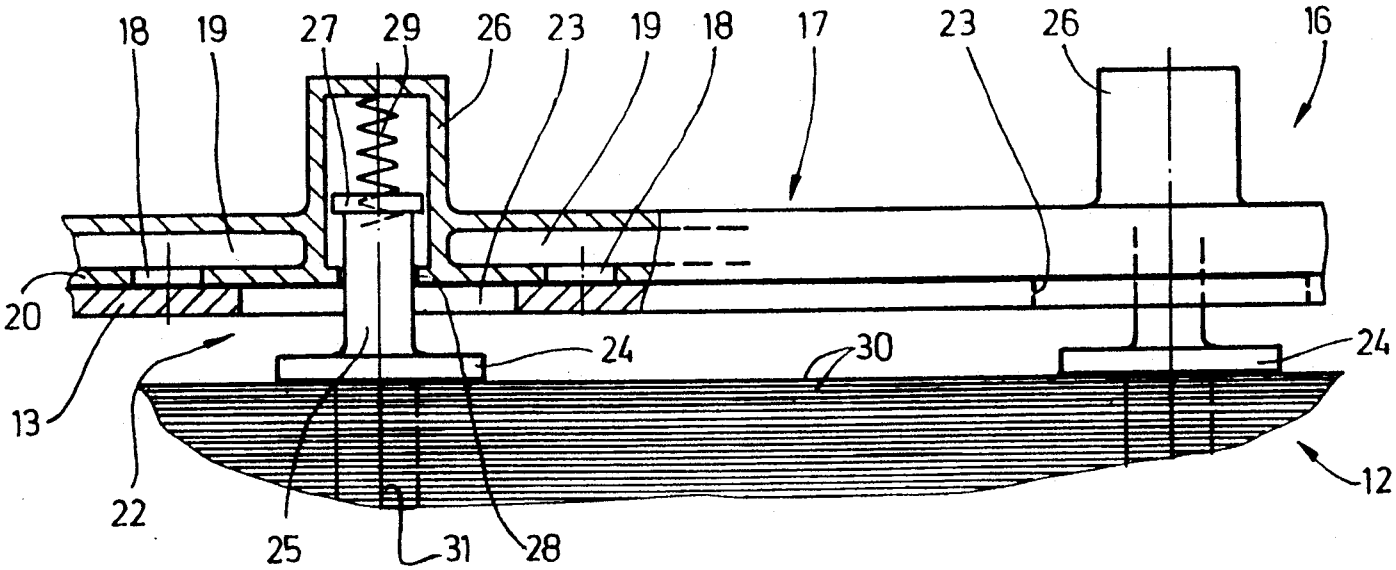
FIG. 6 is a representation according to FIG. 5 showing a stage where an intermediate layer is lifted by the suction lifter.

The profile members 31 are dimensioned such that, when the suction lifter 16 is lowered down, i.e. when the suction plate 17 is resting on the intermediate layer 13, they cover the full height of the cavity 32 or slightly project into the opening 23 of an intermediate layer 13 located thereunder (FIG. 4). When the suction plate 12 is lifted, the profile members 31 are pulled out of the cavities 32 again.

The suction lifter 16 designed in the afore-described way may be arranged on an appropriate apparatus for conducting the lifting and further conveying movements, for instance on a pivoting arm of a palletizer. In the present embodiment, the suction lifter 16 moves in a linear manner above the pallet 10, that is to say above the tiers 11.

For this purpose, a supporting structure 40 comprising upright supports 41 (FIGS. 2 and 3) and a supporting frame 42 arranged on the upper ends thereof and extending in a horizontal plane is provided. This supporting structure 40 has a rectangular cross section.

Crossbars 43, 44 of the supporting frame 42 are linked via guide rails 45, 46 which extend parallel to longitudinal spars 47, 48 and are arranged laterally thereto.

A crossbeam 49 with sliding members 50, 51 on both ends is movably arranged on the guide rails 45, 46. In this embodiment, the crossbeam 49 is moved by means of a rope drive which consists of a traction rope 52 connected with its ends to the crossbeam 49. This traction rope 52 runs over a driving roller 53 on the one crossbar 43 and over a deflecting roller 54 on the opposite crossbar 44. The driving roller 53 is driven by a motor 55, alternatively in either the one or the other direction of rotation, so that the crossbeam 49 can be moved to and fro respectively.

The suction lifter 16 is attached to the crossbeam 49. In the present embodiment, two supporting bars 56, 57 are arranged on the top side of the suction plate 17. These supporting bars 56, 57 penetrate the crossbar 49 and are each held in a bearing sleeve 58 for conducting sliding movements. At the top side of the crossbeam 49 there is also located a pressure means cylinder 59 for conducting the up-and-down movements of the suction lifter 16 via the supporting rods 56, 57.

The actuating apparatus as described above moves the suction lifter 16 in lifted position backwards and forwards between a depositing position (FIG. 2) and a receiving position. In the depositing position, the suction lifter 16 is located above an empty pallet 60, on which the intermediate layers 13 are placed. In the receiving position, the suction lifter 16 is located above the pallet 10.

What is claimed is:

1. An apparatus for lifting a planar sheet (13) from top surfaces of a plurality of vertically oriented stacks (12) of articles (30), wherein the planar sheet (13) contains a plurality of openings (23);

wherein said apparatus comprises a suction lifter (16) which contains a plurality of suction bores and which is adapted to be placed on a top side of the sheet (13) with said suction bores in contact therewith, and a plurality of holding-down devices (22) which are mounted on said suction lifter (16) for vertical movement relative thereto, which are dimensioned to permit them easily to pass through the openings (23) when said suction lifter (16) contacts the sheet (13), and which bear vertically against said top surfaces of the stacks (12) while the sheet (13) is grasped and lifted off the top surfaces by said suction lifter (16);

wherein said holding-down devices (22) are vertically movably mounted on said suction lifter (16) and resiliently loaded such that lower ends (24) of the holding-down devices (22) abut said top surfaces of said stacks (12) during a first stage of upward movement of the suction lifter (16) with the grasped sheet (13); and wherein each of the holding-down devices (22) comprises a stamp plate (24) which abuts a bottom side of the suction lifter (16) while projecting into an opening (23) of the sheet (13) and when the holding-down devices (22) are in a retracted position as a result of the suction lifter (16) being placed in contact with the sheet (13).

2. The apparatus of claim 1, further comprising, in combination:

a planar sheet (13) containing a plurality of openings (23);

means for lowering said suction lifter (16) into contact with said sheet (13) to grasp the sheet by suction, and for raising said suction lifter (16) to lift off the grasped sheet (13); and means coupling said suction lifter (16) to a source of vacuum.

3. An apparatus for lifting a planar sheet (13) from top surfaces of a plurality of vertically oriented stacks (12) of articles (30), wherein the planar sheet (13) contains a plurality of openings (23);

wherein said apparatus comprises a suction lifter (16) which contains a plurality of suction bores and which is adapted to be placed on a top side of the sheet (13) with said suction bores in contact therewith, and a plurality of holding-down devices (22) which are mounted on said suction lifter (16) for vertical movement relative thereto, which are dimensioned to permit them easily to pass through the openings (23) when said suction lifter (16) contacts the sheet (13), and which bear vertically against said top surfaces of the stacks (12) while the sheet (13) is grasped and lifted off the top surfaces by said suction lifter (16);

said apparatus further comprising a planar sheet (13) containing a plurality of openings (23);

means for lowering said suction lifter (16) into contact with said sheet (13) to grasp the sheet by suction, and for raising said suction lifter (16) to lift off the grasped sheet (13); and means coupling said suction lifter (16) to a source of vacuum;

wherein said planar sheet (13) is initially located in a horizontal plane and sandwiched between top and bottom tiers (11) of stacks (12);

said apparatus further comprising means (15) for pushing the top tier off in the horizontal direction to expose said planar sheet prior to lowering of said suction lifter (16).

4. The apparatus as claimed in claim 2 or 3, wherein said openings (23) are distributed in a grid-like manner, and wherein each opening (23) is considerably larger than a portion of a holding-down device (22) which passes through said opening (23).

5. The apparatus as claim in claim 3, wherein said holding-down devices (22) are vertically movably mounted on said suction lifter (16) and resiliently loaded such that lower ends (24) of the holding-down devices (22) abut said top surfaces of said stacks (12) during a first stage of upward movement of the suction lifter (16) with the grasped sheet (13).

6. The apparatus as claimed in claim 1 or 3, wherein each of said holding-down devices (22) has the shape of a piston, and each holding-down device (22) has a connecting rod (25) with which it is movably mounted in a cylindrical rod housing (26) of the suction lifter (16), and wherein said holding-down devices (22) are spring-biased in an extended position by a pressure spring (29).

7. The apparatus as claimed in claim 3, wherein each of the holding-down devices (22) comprises a stamp plate (24) which abuts a bottom side of the suction lifter (16) while projecting into an opening (23) of the sheet (13) and when the holding-down devices (22) are in a retracted position as a result of the suction lifter (16) being placed in contact with the sheet (13).

8. The apparatus as claimed in claim 7 or 2, wherein the openings (23) in the sheet (13) and, correspondingly, the holding-down devices (22) are distributed such that four stacks (12), located underneath the sheet (13) to be lifted, are engaged, in the region of stack corners directed towards one another, by only one holding-down device (22) and by the stamp plate (24) thereof.

9. The apparatus as claimed in claim 1 or 3, wherein said suction lifter comprises elongate guide means mounted on a bottom surface thereof, said guide means comprising elongated rod members which, when the suction lifter (16) is lowered onto said top surfaces of said plurality of stacks (12), arranged next to one another in a tier (11), enter cavities (32), formed between said stacks, in a form-fitted positive manner.

10. The apparatus as claimed in claim 9, wherein said elongated rod members (31) are arranged on a bottom side of the holding-down devices (22), and pass through the openings (23) formed in the sheet (13).

11. The apparatus as claimed in claim 9, wherein said elongated rod members (31) have an angular V-shaped cross-section and enter correspondingly formed cavities (32), between adjacent stacks (12) of blanks for hinge lid packs, in a form-fitting positive manner.

12. The apparatus claimed in claim 9, wherein the length of said elongated rod members (31) is slightly greater than the height of a stack (12), so that a lower end of each elongated rod member (31) enters an opening (23) of another planar sheet (13) located underneath said stack (12).

13. The apparatus as claimed in claim 6, wherein the suction lifter (16) comprises an up-and-down movable suction plate (17) which has a continuous vacuum chamber (19) and in which the rod housings (26) for the holding-down devices (22) are arranged.

14. The apparatus as claimed in claim 1 or 3, further comprising: a crossbeam 49, a frame-like supporting structure (40) and lateral guide rails (45, 46), wherein the suction lifter (16) is mounted on said crossbeam (49) in an up-and-down movable manner; and a rope drive (52) for moving said crossbeam (49) in said frame-like supporting structure (40) on said lateral guide rails (45, 46).

* * * * *